United States Patent [19]

Cave et al.

[11] 4,417,423

[45] Nov. 29, 1983

[54] STYLUS MANUFACTURING METHOD

[75] Inventors: Eric F. Cave; James J. Cowden, both of Indianapolis, Ind.

[73] Assignee: RCA Corporation, New York, N.Y.

[21] Appl. No.: 310,857

[22] Filed: Oct. 13, 1981

[51] Int. Cl.[3] ..... B24B 1/00

[52] U.S. Cl. ..... 51/283 R; 51/229; 51/131.1; 125/30 R

[58] Field of Search ..... 51/283, 131.1, 229, 51/125.5; 125/30 R

[56] References Cited

U.S. PATENT DOCUMENTS

| | | | |
|---|---|---|---|
| 2,655,768 | 10/1953 | Bartell | 51/131.1 |
| 3,626,644 | 12/1971 | Cupler | 51/283 |
| 4,104,832 | 8/1978 | Keizer | 51/281 R |
| 4,162,510 | 7/1979 | Keizer | 358/128 |
| 4,372,042 | 2/1983 | Hughes | 51/283 R |

OTHER PUBLICATIONS

D. Crompton et al., "The Wear of Diamond," *Proceedings of the Royal Society (London), A,* vol. 333, pp. 435–454 (1973).

M. Seal, "The Abrasion of Diamond," *Proceedings of the Royal Society A,* vol. 248, pp. 379–393 (1958).

F. P. Bowden et al., "The Polishing, Surface Flow and Wear of Diamond and Glass" *Proceedings of the Royal Society, A,* vol. 248, pp. 368–378 (1958).

E. M. Wilks et al., "The Resistance of Diamond to Abrasion," *Journal of Physics D: Applied Physics,* vol. 5, pp. 1902–1919 (1972).

R. Berman, Editor, *Physical Properties of Diamond,* Clarendon Press, Oxford, 1965, pp. 209–220.

*Primary Examiner*—Harold D. Whitehead

*Attorney, Agent, or Firm*—Birgit E. Morris; Joseph D. Lazar

[57] ABSTRACT

A method for forming a face on a crystalline dielectric material having anisotropic crystallographic hardness. The method includes the steps of contacting the dielectric material with an abrasive surface having a loosely bound charge of abrasive particles, while maintaining relative motion between the dielectric material and the abrasive surface, and isotropically coning the dielectric material by continuously rotating the dielectric material and applying a force between a dielectric material and the abrasive surface which allows a face to be produced in the dielectric material because of its anisotropic crystallographic hardness.

10 Claims, 7 Drawing Figures

STYLUS MANUFACTURING METHOD

This invention relates to a method for manufacturing a capacitive information disc playback stylus. More particularly this invention relates to the manufacture of a playback stylus of a dielectric material having anisotropic hardness.

BACKGROUND OF THE INVENTION

Capacitive information disc playback styli are generally fabricated from hard dielectric materials such as diamond, sapphire, and the like. In order to reduce cost the dielectric material is mounted in a shank rather than employing a relatively large block of the dielectric material. The shank may be a metal such as titanium or any other suitable material.

Diamond is a preferred dielectric material because of its long wearing properties. In order to reduce cost either a synthetic or a natural diamond mounted in a shank may be employed. Diamond, like other dielectric materials, has an anisotropic hardness which depends on the crystallographic direction.

The diamonds as well as the other dielectric materials often have various crystalline faces which are undesirable for producing uniform video disc playback styli. One method for producing uniform styli is to form a cone at the tip of the dielectric material opposite the shank. The cone end is then shaped so that a disc engaging terminal portion is formed which can be employed to recover information from the capacitive information disc.

A problem caused by coning is the loss of the crystalline faces which provide a means for orienting the dielectric material and determining whether it is properly aligned—that is, the crystallographic axis has the desired relationship to the shank axis.

SUMMARY OF THE INVENTION

I have found a method for forming a face on a crystalline dielectric material having anisotropic crystallographic hardness during the formation of a tapering tip end. The method comprises the steps of contacting the dielectric material with an abrasive surface having a loosely bound charge of abrasive particles, while maintaining relative motion between the dielectric material and the abrasive surface, and isotropically coning the dielectric material by both continuously rotating the dielectric material and applying a force between the dielectric material and the abrasive lapping surface which allows a face to be produced in the dielectric material because of its anisotropic crystallographic hardness. The face may be employed to determine the orientation of the dielectric material.

DETAILED DESCRIPTION OF THE INVENTION

Figure 1:
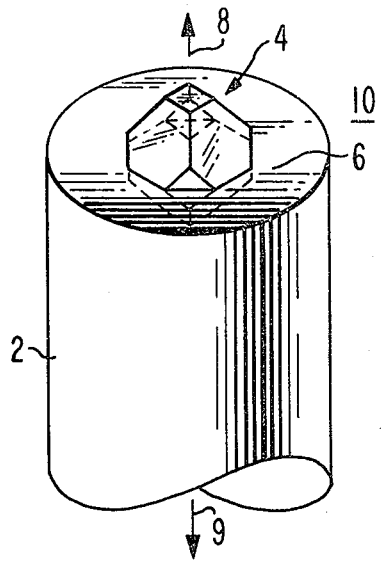
FIG. 1 is a perspective view of a crystalline dielectric material bonded to a shank.

In the present invention one or more faces may be formed in a dielectric material having an anisotropic crystallographic hardness during its coning. Because of crystallographic asymmetric hardness which exists in certain synthetic and naturally occurring crystalline dielectric materials, certain crystallographic faces and directions will be preferentially abraided. When the present method is employed using a crystalline dielectric material having asymmetric crystallographic hardness, certain areas will be preferentially removed even though the dielectric material and the abrasive surface are being uniformly and isotropically rotated and contacted with each other.

The dielectric material is contacted with an abrasive surface having a loosely bound charge of abrasive particles. For diamond a suitable charge is diamond particles about 2–4 micrometers in diameter. The charge can be deposited with a light oil on a scaife. A suitable scaife may be one coated with a tungsten carbide coating such as Union carbide L-10-40.

The formation of the face is primarily a function of the abrasive surface employed. If too abrasive a surface is employed, for example, a diamond-bonded wheel, no faces are formed during the coning operation. Instead a uniform, smooth cone is produced. A suitable force must be applied between the dielectric material and the abrasive surface so that the desired face forms. For an element having a synthetic diamond bonded to a titanium shank with a braze which includes silver and copper, a unit force between about 20–60 grams, preferably 30–40 grams, may be employed. If a unit force of less than about 20 grams is employed, too long a time is required for the coning operation. If a unit force greater than about 60 grams is employed, the element becomes too hot causing the braze to fail and the diamond to either loosen or fall out.

The portion of the dielectric material and any of the shank which is to be coned are contacted with a rotating abrasive surface with the appropriate force as previously discussed. A shanked diamond dielectric material can be rotated, for example, at 60 revolutions per minute while in contact with an abrasive surface which is itself rotating at, for example, between about 2,000 and 3,000 revolutions per minute.

The present invention will be further illustrated by means of the Drawing. However, it is to be understood that the invention is not meant to be limited by the details subscribed therein.

FIG. 1 is a perspective view of a shanked dielectric material element 10. The element 10 includes a titanium shank 2. To one end of the shank is bonded a dielectric material 4, for example, a synthetic diamond having a cubo-octahedral crystalline morphology. The dielectric material 4 may be bonded to the shank 2 to form an interface 6 by brazing, soldering, or by other means known in the art to join the dielectric material 4 to the shank 2. The cubo-octahedral synthetic diamond is bonded such that the axis of four-fold symmetry, shown by first arrow 8, is aligned with the major axis of the shank 2, shown by a second arrow 9. The four-fold symmetry axis corresponds to the {100} crystallographic direction.

Figure 2:
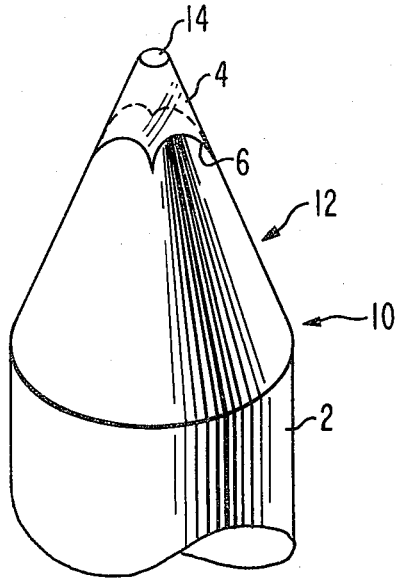
FIG. 2 is a perspective view of the shanked dielectric material after rough coning.

FIG. 2 is a perspective view of the shanked dielectric material element 10 after rough coning. In rough coning a cone 12, illustratively having an angle of 40 degrees, is formed at the end of the element 10. The purpose of rough coning is to remove material, so that the face-forming coning step can be performed in less time. The cone tip end 14 is approximately round after the rough coning step. For a diamond dielectric material, a diamond-bonded wheel will result in a cone which does not have a face formed in it.

Figure 3:
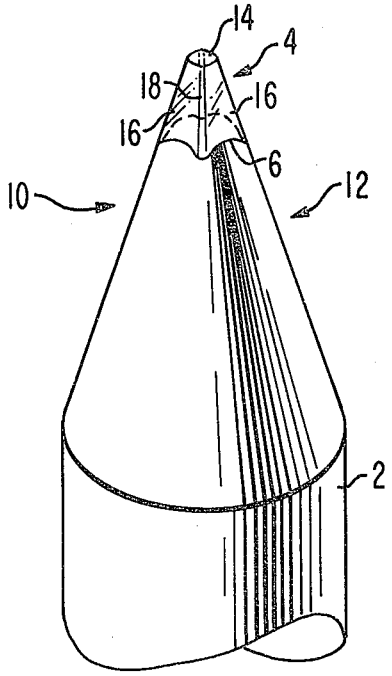
FIG. 3 is a perspective view of the shanked dielectric material prepared in accordance with the present invention.

FIG. 3 is a perspective view of the shanked dielectric material element 10 which has been coned according to the present invention to form four faces 16. During face-forming coning the cone 12 having a cone angle of, illustratively, about 30 degrees is formed. Because of the crystallographic asymmetric hardness, a symmetric four-faced square pyramid is formed. Each of the four faces 16 is not flat but has some curvature. Edges 18 separate each of the faces 16. A face 16 may be used to determine the orientation of the synthetic diamond 4 in the shank 2. Also, the cone tip end 14 is approximately a square having rounded sides which may be used to determine the orientation. A misoriented diamond should not have a square cone tip end 14.

Figure 4:
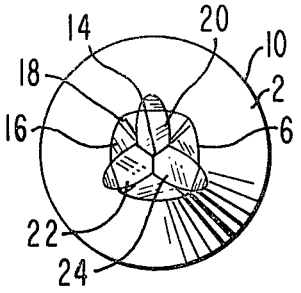
FIG. 4 is a frontal view of the shanked dielectric material having three flats.

FIG. 4 is a frontal view of a shanked dielectric material element 10 in which three flats have been lapped in the cone tip. The first flat 20 is the electrode surface and is lapped so that it aligns with one of the faces 16. Alternatively, one of the faces 16 may serve as the electrode surface. The electrode surface may be made conductive by, for example, an evaporated layer of a conductive metal such as titanium, haffium, and the like or by a layer of ion implanted boron ions. A second flat 22 and a third flat 24 may be lapped into the cone tip. Any known method may be employed to lap the three flats 20, 22 and 24 such as lapping on a diamond powder charged scaife. The cone tip end 4 is now a point.

Figure 5:
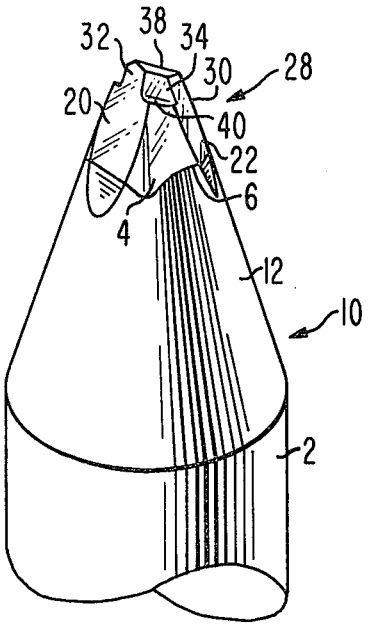
FIGS. 5 and 6 are perspective views of a keel-tipped stylus.
Figure 6:
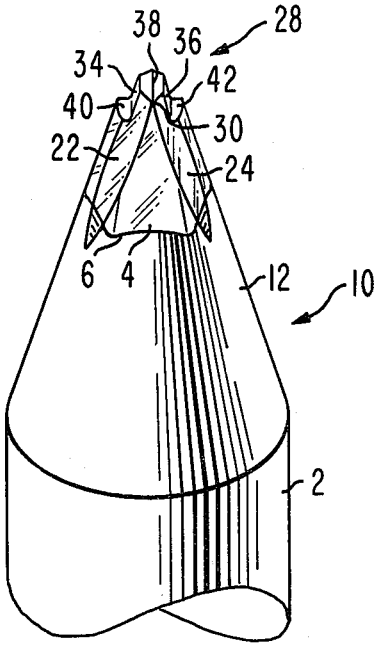

FIGS. 5 and 6 are perspective views of a shanked dielectric material element 10 having a keel-tip 28. A keel-tipped stylus has been described by Keizer in U.S. Pat. Nos. 4,104,832 and 4,162,510. The Keizer keel-tip 28 includes the terminating portion of the stylus having a prow 30 formed by the convergence of the second flat 22 and third flat 24, a substantially flat rear surface 32, which is part of the first flat 20, remote from the prow 30, a pair of substantially parallel surfaces 34 and 36, a disc engaging surface 38 and shoulders 40 and 42 which interconnect the parallel surfaces 34 and 36, respectively, with the nonconstructed portion of the cone tip by means of smooth, concave junctions. This stylus may be employed with either a grooved or ungrooved capacitive information disc. For a grooved disc, the disc engaging surface 38 should preferably conform to the groove shape, for example, a "V" as shown in FIGS. 5 and 6. If one of the coned faces 16 is employed as the electrode face, the rear surface 32 will be somewhat rounded.

The shanked dielectric material element 10 shown in FIG. 4 may be employed to form the keel-tipped stylus. A substrate having an abrasive-coated, deep, course-pitched groove can be utilized. A preferred abrasive coating is glow-discharge deposited silicon oxide using $N_2O$ and $SiH_4$ as the starting materials, as described in copending application of Kaganowicz, Ser. No. 963,819, filed Nov. 27, 1978 now U.S. Pat. No. 4,369,604, issued Jan. 25, 1983.

Figure 7:
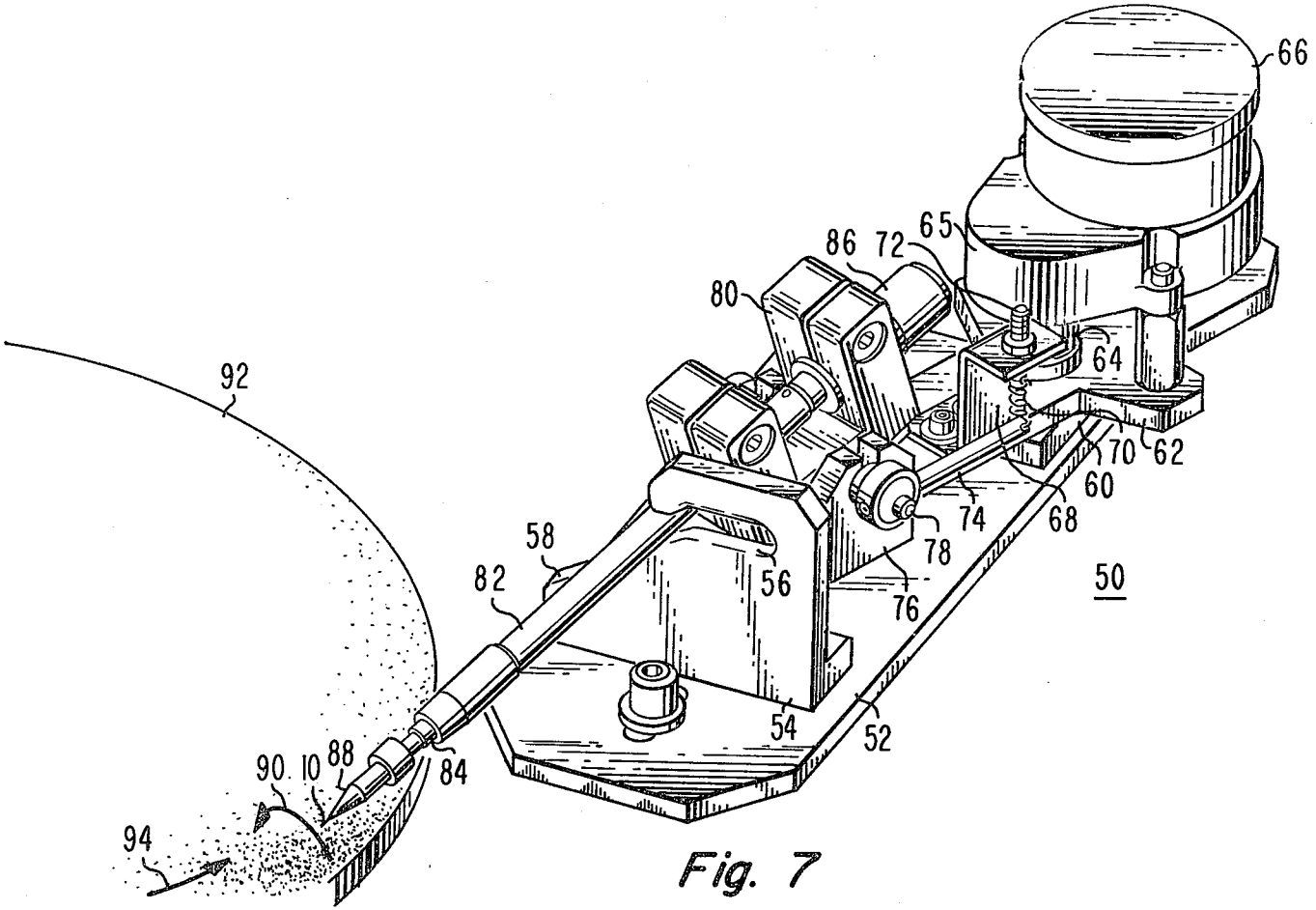
FIG. 7 is a perspective view of an apparatus which can be employed in carrying out the present invention.

FIG. 7 is a perspective view of an apparatus 50 which may be employed in carrying out the present invention. The apparatus includes a first support 52. Mounted on a front portion of the first support 52 is a ramp block 54. The ramp block 54 includes a slot 56 and a ramp 58. The ramp 58 may advantageously have two regions of different slope, with the region closest to the slot 56 having a greater slope.

At the rear of the first support 52 is mounted a second support 60. A motor plate 62 is rotatably attached to the second support 60 by means of a spindle 64. A thrust bearing 65 interconnects a stepper motor 66 to the spindle 64.

A support bracket 68 is mounted at one end to the motor plate 62. The support bracket 68 is connected at its other end to one end of an extension spring 70 by means of a screw 72 which can adjust the tension of the spring 70. The other end of the spring 70 is connected to one end of an arm 74.

A clevis bracket 76 is also mounted on the motor plate 62. An axle 78 rests on the clevis bracket 76. The other end of the arm 74 is connected to the axle 78. A housing 80 is fixed to a central portion of the axle 78. A tube 82 passess through and is attached to the housing 80. A shaft 84 is rotatably held in the tube 82. The shaft end closest to the housing 80 is rotatably connected to a micromotor 86. The other end of the shaft 84 is connected to an element holder 88 which holds the shanked dielectric material element 10. The direction of rotation of the shaft 84 is shown by a third arrow 90.

During the face-forming coning operation, the shanked dielectric material element 10 contacts a scaife 92 having an abrasive surface. The direction of rotation of the scaife 92 is shown by a fourth arrow 94.

For a cubo-octahedral synthetic diamond oriented so that the {100} crystallographic direction is aligned with the shank axis, the direction of rotation of the scaife 92 relative to the {100} crystallographic direction is important. When the direction of rotation is as indicated by the fourth arrow 94 and the {100} direction points in the direction of the incoming scaife, the face-forming coning operation proceeds relatively rapidly with the formation of four first faces 16. When the {100} direction points opposite the direction of the incoming scaife, e.g., the direction of the fourth arrow 94 is reversed, the face-forming operation proceeds relatively slowly with the formation of four second faces which are offset about 45 degrees from the first face 16. Other orientation of the four fold axis relative to the direction of rotation of the scaife or the use of an axis other than the {100 direction} can lead to different results. However, the direction of rotation of the shaft 84 has not been found to affect either the rate at which the face-forming coning operation occurs or the crystallographic orientation of the faces which form.

In employing the apparatus 50 for the face-forming coning operation, the micromotor 86 is engaged so that the shaft 84, illustratively, rotates at 60 revolutions per minute and the scaife 92 is rotated, illustratively, at 2,000–3,000 revolutions per minute. With the tube 82 in the slot 56 at the end farthest from the ramp 58, a series of pulses are fed to the stepper motor 66.

Illustratively, each pulse step is 7.5 degrees of radial arc, modified by a 75:1 gear reduction to obtain a smooth motion. To have the tube 82 pass through the slot 56, the steeper part of the ramp 58, and the shallower sloped portion of the ramp 58, so as to allow soft setdown of the shanked dielectric material element 10 on the scaife 92, and to have the element 10 sweep across the scaife 92, 65 pulse were employed. Additional sweeps between the ramp 58 and an inner radius of the scaife 92 were satisfactorily performed using 35 pulses, which corresponds to 50 oscillations per minute. The screw 72 was adjusted so that the tension spring 70 provided a unit force of about 30–40 grams to the element 10 on the scaife 92.

The preferred angle between the scaife 92 and the shaft 84 is about 15 degrees. At greater angles, the coning operation proceeds more rapidly. However, since less of the dielectric material is removed at greater angles, more material must be removed during the subsequent lapping and shaping of the element 10 to fabricate a playback stylus. At lesser angles, an element having a small cone angle is formed. Such an element is fragile which results in difficulties in handling and in further processing.

Using the values for force, rotational speeds, and oscillations illustratively given above, for a scaife 92 charged with diamond particles having a diameter of about 2 to 4 micrometers, a titanium shanked synthetic diamond dielectric material element 10, rough coned to have a cone angle of about 40 degrees, can be face-forming coned to a cone angle of 30 degrees with four faces formed in the diamond symmetrically disposed about the four-fold axis in about 30 seconds. If the element 10 is not rough coned, about 6–10 minutes are generally required to obtain the same results.

We claim:

1. A method for forming four faces on a diamond having anisotropic crystallographic hardness during the formation of a tapering tip end comprising the steps of:

orienting the diamond for rotation about the {100} crystallographic direction of the diamond corresponding to the four-fold axis of symmetry of the diamond, contacting the diamond with an abrasive surface having a loosely-bound charge of abrasive particles while maintaining relative motion between the diamond and the abrasive surface such that the {100} crystallographic direction is at an acute angle with the abrasive surface; and isotropically coning the diamond by continuously rotating the diamond and applying a force between the diamond and the abrasive surface which allows four faces to be formed in the diamond because of its anisotropic crystallographic hardness, the form of the diamond thereby being a symmetric four-faced square pyramid.

2. A method in accordance with claim 1 wherein the abrasive particles are diamond.

3. A method in accordance with claim 2 wherein the diameter of the diamond particles is about 2 to 4 micrometers.

4. A method in accordance with claim 1 wherein the unit force is between about 20 and 60 grams.

5. A method in accordance with claim 4 wherein the unit force is about 30–40 grams.

6. In a method for preparing a capacitive information disc playback stylus comprising the step of preparing an electrode layer by forming a surface in a diamond, the improvement comprising the steps of forming the surface by:

employing a diamond having anisotropic crystallographic hardness, orienting the diamond for rotation about the {100} crystallographic direction of the diamond corresponding to the four-fold axis of symmetry of the diamond, forming a tapering tip end in the diamond by contacting the diamond with an abrasive surface having a loosely-bound charge of abrasive particles while maintaining relative motion between the diamond and the abrasive surface such that the {100} crystallographic direction is at an acute angle with the abrasive surface;

isotropically coning the diamond by continuously rotating the diamond and the abrasive surface which allows four faces to be formed in the diamond because of its anisotropic crystallographic hardness, the form of the diamond thereby being a symmetric four-faced square pyramid; and selecting one of said four faces for preparing said electrode layer.

7. A method in accordance with claim 6 wherein the abrasive particles are diamond.

8. A method in accordance with claim 7 wherein the diameter of the diamond particles is about 2 to 4 micrometers.

9. A method in accordance with claim 6 wherein the unit force is between about 20 and 60 grams.

10. A method in accordance with claim 9 wherein the unit force is about 30–40 grams.

* * * * *